US009631824B1

(12) United States Patent
Maisey et al.

(10) Patent No.: US 9,631,824 B1
(45) Date of Patent: Apr. 25, 2017

(54) LIQUID DESICCANT HVAC SYSTEM

(71) Applicants: Grahame Ernest Maisey, Wyncote, PA (US); Beverly Milestone, Wyncote, PA (US)

(72) Inventors: Grahame Ernest Maisey, Wyncote, PA (US); Beverly Milestone, Wyncote, PA (US)

( * ) Notice: Subject to any disclaimer, the term of this patent is extended or adjusted under 35 U.S.C. 154(b) by 0 days.

(21) Appl. No.: 15/264,914

(22) Filed: Sep. 14, 2016

(51) Int. Cl.

| | |
|---|---|
| ***F25D 21/14*** | (2006.01) |
| ***F24F 3/14*** | (2006.01) |
| ***F24F 3/147*** | (2006.01) |
| ***F24F 13/28*** | (2006.01) |
| ***F24F 13/20*** | (2006.01) |

(52) U.S. Cl.
CPC ..... *F24F 3/1417* (2013.01); *F24F 3/147* (2013.01); *F24F 13/20* (2013.01); *F24F 13/28* (2013.01); *F24F 2003/1435* (2013.01); *F24F 2003/1458* (2013.01)

(58) Field of Classification Search
CPC ..... F24F 3/1417; F24F 3/147; F24F 13/20; F24F 13/28; F24F 2003/1458; F24F 2003/1435
USPC ..... 62/93, 271, 176.4
See application file for complete search history.

(56) References Cited

U.S. PATENT DOCUMENTS

| | | | | |
|---|---|---|---|---|
| 3,683,591 A * | 8/1972 | Glav | B01D 53/261 | 95/123 |
| 4,180,126 A * | 12/1979 | Rush | F24F 3/1423 | 165/59 |
| 4,180,985 A * | 1/1980 | Northrup, Jr. | B01D 53/26 | 62/271 |
| 5,297,398 A * | 3/1994 | Meckler | B01D 53/261 | 62/271 |
| 5,661,983 A * | 9/1997 | Groten | B01D 53/261 | 62/271 |
| 8,685,142 B2 * | 4/2014 | Claridge | F24F 5/0035 | 95/43 |
| 2001/0015077 A1 * | 8/2001 | Potnis | B01D 53/263 | 62/497 |
| 2003/0140793 A1 * | 7/2003 | Lacey | B01D 35/02 | 96/108 |
| 2004/0031282 A1 * | 2/2004 | Kopko | F24F 3/1417 | 62/271 |
| 2005/0262720 A1 * | 12/2005 | Rane | B01D 53/263 | 34/330 |
| 2006/0156750 A1 * | 7/2006 | Lowenstein | F24F 3/1417 | 62/271 |
| 2007/0144350 A1 * | 6/2007 | Paling | B01D 53/261 | 96/134 |
| 2010/0122805 A1 * | 5/2010 | Yang | F24F 3/1411 | 165/164 |
| 2013/0032318 A1 * | 2/2013 | Niebur | F24F 3/147 | 165/166 |

* cited by examiner

*Primary Examiner* — Mohammad M Ali

(57) ABSTRACT

A method and system for conditioning air utilizing a liquid desiccant and the ability to use low grade and clean renewable heat sources for heating, cooling, dehumidifying and humidifying air as well as regenerating desiccant, with a low temperature differential for inlet and outlet air. Said system provides some filtering, purifying and sterilization of air. Said system may have low resistance through the system to lower fan energy. Said system may have low resistance through system pipework to lower pump energy.

4 Claims, 3 Drawing Sheets

LIQUID DESICCANT HVAC SYSTEM

CROSS REFERENCE TO RELATED APPLICATION

This application claims the benefit of PPA Ser. Nr. 098737.000001 filed 16 Sep. 2015 by the present inventor, which is incorporated by reference in its entirety.

FIELD OF INVENTION

This invention relates to a liquid desiccant heating, ventilating and air conditioning system with energy recovery.

BACKGROUND

The electrical and fossil fuel energy used in buildings and other spaces for heating and cooling comprises around 30% of all energy used in the USA and 40% of the electricity used, together with being totally responsible for the peak electrical loads in the summer that create blackouts. Much of this energy is originally from fossil fuel sources and the level of usage of fossil fuels is currently causing much concern. As ever more people throughout the world are looking to add air conditioning systems and as the climate continues to change with the increasing temperatures and humidity in the summer and the increasing cold snaps in the winter, this problem will only be exacerbated. In particular, current air conditioning is almost entirely powered by electricity which creates the peak electrical load that requires a high level of expensive peak power generation plant capacity. In September 2016, the USA and China signed the Paris agreement and just a couple of months before, the US Secretary of State declared at a UN meeting that air conditioning refrigerants were a bigger global threat than ISIS. It is time for a radically different approach to providing health and comfort to the indoor climate. Electricity developed from renewable sources or low use electric air conditioning can remove the peak electrical load.

The Laws of Thermodynamics warn against the use of higher energy sources to create lower energy sources as not only being wasteful but also very inefficient. Currently, fossil fuels are the high energy sources used to produce steam heat, which is a lower energy source, to drive turbine engines which generate electricity, a higher energy source. Fossil fuels themselves are raw energy sources that have taken considerable energy to produce, refine and convey to electric power plants. The electricity thus produced is moved along many miles of cables for use with electric motors that turn refrigeration compressors to create cooling in buildings. The total efficiency of this system may be only 10%.

Air conditioning by electrical compressors has difficulty in removing the humidity from the air in humid climates, particularly when dealing with 100% outside air. The process of dehumidifying through electric compressors involves supplying a cold enough chilled water or refrigerant to a cooling coil such that the air passing through the coil is cooled to below the dewpoint and moisture is condensed out of the airstream. This almost saturated air is then supplied to the space to be conditioned. The temperature of the air required to remove the preferred amount of moisture is so low that the extra electricity required may be a further 25%. This extra electricity will also be necessary if the system requires 100% outside air. Additionally, this leads to higher than preferred humidity in spaces and more recirculated air when the temperature outside is either hot and humid or cold and dry. This leads to poor indoor environmental conditions at the expense of energy conservation. A large quantity of primary energy supplied from fossil fuels and electricity results in waste heat, about 31% globally.

Most current heating, ventilating and air conditioning (HVAC) systems provide a minimum of outside air and have a mechanical particulate filter system. This filter system does not purify or sterilize the air supply nor does it remove unwanted gases and pollutants from the air supply. Recirculating the air through these systems may be a primary transmission method of colds, flu and other types of infections in buildings.

Many current HVAC systems provide very poor dehumidification during summer months and often no humidification during winter months so that the occupants may be uncomfortable almost year round. Many studies have shown that the discomfort of occupants along with maintenance complaints cause hundreds of billions of dollars in lost productivity yearly in the US. The health of building occupants may be compromised by the HVAC system such that transmission of diseases and the promotion of fungi, etc in the HVAC system and building are not prevented.

Desiccant-based dehumidifiers, such as Kathabar, have been introduced to the market on a number of occasions over the past 75 years but they have only achieved a very small market penetration and they have not been well received for a number of reasons, in addition to those previously mentioned. Firstly, they have been expensive to buy and any energy savings from their use has not been sufficient to payback the capital cost in a timescale considered economic to most building owners and operators. Secondly, the designs of first and some second-generation liquid desiccant systems were prone to allow micro droplets of the liquid desiccant to carryover into the building space served, which was highly undesirable because of contamination of the space and also the loss of the desiccant in the system.

Although several liquid desiccant type air conditioning systems have been developed, such as by AIL Research and DuCool, energy recovery has not been optimized. Once the systems are installed, there is no flexibility in where the used liquid desiccant (or working fluid) goes. It can all circulate to either a storage tank or into the regenerator storage, but there are no or too little other options which means that, even if some of the desiccant is still either highly concentrated, as in the cooling phase, or still highly diluted, as in the warming phase, it will still go the same path as more used liquid desiccant This is not the most efficient use of the liquid desiccant.

In such cases where a liquid desiccant is used, as in those systems already mentioned along with other systems such as those developed by 7AC, the flow pipe travels to the end of the flow and the return pipe travels from the end of the flow to the beginning of the flow pipe. This piping system is known as a flow and return system, the most common piping system used. This type of pipework steadily loses pressure through the flow pipe run which is at its lowest by the time it reaches the longest flow pipe, known as the index run. This is a very inflexible system as it is less possible to add more pads to the end of conditioner or regenerator and it is more difficult to balance if pads are removed. Therefore, the systems are inflexible for expansion or contraction and change of performance.

Current liquid desiccant air conditioning systems are not very flexible in sizing. Once the system is selected and installed, it is difficult to adjust the conditioner or regenerator to a larger or smaller air volume or vary the performance more than 10%. This is a limitation for the building owner as they thus must add additional units or run the system at the lower setting which is not the optimized system setting or purchase an entirely new system.

Current liquid desiccant systems, while able to be more efficient than conventional air conditioning refrigeration units, often still require quite low chilled water temperatures for cooling and quite high temperature heating for the desiccant regeneration process along with quite high heating temperatures in the winter for warming, while many do not offer a humidification option. Temperature differentials of 85° C. or more between chilled water temperatures and regeneration heating temperatures are often required. To attain such temperature differentials requires mechanical heating or cooling which requires more energy.

Maintenance is a huge problem with current HVAC systems and refrigeration systems. The over-complicated systems require too much maintenance and specialized technicians so that they are rarely subject to preventive maintenance. This lack of preventive maintenance creates energy inefficiency and an occupant comfort problem.

For the foregoing reasons, there is a need for a liquid desiccant air conditioning system that can answer all the problems building owners, building occupants and the over-stretched electric grid face.

PRIOR ART

Griffiths, U.S. Pat. No. 4,164,125 discloses a system where tubes containing a liquid desiccant circulate through solar collectors, the desiccant then contacting an air stream that is cooled in heat exchange with water from a cooling tower.

Al-Hadhrami, U.S. Patent Application No. 2011/0138832, circulates oil through a solar collector that provides heat to evaporate moisture from the desiccant followed by an indirect evaporative cooler.

Kopko, U.S. Pat. No. 6,513,339, has a liquid desiccant in contact with heated air within a solar collector, contacting this desiccant with an air stream and then removing the heat of absorption by employing an indirect evaporative cooler.

Albers et al., U.S. Pat. No. 5,123,481 describe a process of dehumidification that employs multiple stages that are similar to the sectors used in the current invention. Albers, et al. use a second chamber in which water is evaporated as a heat sink.

Albers et al., U.S. Pat. No. 5,146,978 has a single chamber that uses compression of the gas through the apparatus.

Albers et al., U.S. Pat. Nos. 4,982,782, 5,020,335 and 5,020,588 use a heat connecting partition and a plurality of gas streams.

Lowenstein, U.S. Pat. No. 5,351,497, uses low flow desiccant system that is not turbulent.

Gerber, et al., U.S. Pat. No. 9,109,808 B2, discloses a variable desiccant control energy exchange system and method.

Vandermeulen, et al., U.S. Pat. No. 9,008,223 B2, discloses methods and systems for desiccant air conditioning.

Vandermeulen, et al., U.S. Pat. No. 8,800,308 B2, discloses methods and systems for desiccant air conditioning with combustion containment filtering.

Forkosh, U.S. Pat. No. 8,943,844 B2, discloses a desiccant based air conditioning system.

Gommed, et al., U.S. Pat. No. 8,887,523 B2, discloses a liquid desiccant dehumidification system and heat/mass exchanger thereof.

Kozubal, et al. U.S. Pat. No. 8,769,971 B2, discloses an indirect evaporative cooler using membrane-contained liquid desiccant for dehumidification.

Chang, et al. U.S. Pat. No. 8,696,805 B2, discloses a heat exchanger for dehumidifier using liquid desiccant and dehumidifier using liquid desiccant having the same.

Claridge, et al., U.S. Pat. No. 8,685,145 B2, discloses a system and method for efficient multi-stage air dehumidification and liquid recovery.

Mongar, U.S. Patent Application No. 2015/0292754 A1 discloses an air conditioner and desiccant regenerator system.

SUMMARY

As discussed in further detail below, various embodiments disclosed herein are for methods and systems of conditioning the air to be received by an enclosed space or process, and reuse or regeneration of the liquid desiccant. Conditioning may include but is not limited to temperature regulation, humidity regulation and quality of air supplied which may include one or more of the following: filtering, purifying and sterilization.

In accordance with one or more embodiments, the system is scalable in size and is adaptable and flexible. Systems airflow sizes with paper or other material media pads may be from 5 L/s (liters per second) to 50,000 L/s with single height media pads, giving the system the ability to be easily produced in both large sizes for commercial, institutional and industrial use and in small sizes for residential and single room applications. The system may be a stand-alone HVAC unit or be the treatment section for the outside air for a larger HVAC unit. The system may be increased in size by stacking sections or having sections adjacent one another where specified.

In accordance with one or more embodiments, the invention is an air conditioning system with an air stream that may be 100% outside air or a proportion of recirculated air from the space served together with outside air, or 100% recirculated air from the space or process served. The air is humidity and temperature controlled, and filtered, purified, and sterilized to some degree by contact with media pads or other absorbent material wetted with a liquid desiccant of appropriate concentration and temperature. If the air entering the unit is more humid than desired, the air is dehumidified by contact with media pad or pads wetted with liquid desiccant. The concentration of the desiccant supplied to the device determines the humidity content of the conditioned air exiting from the unit. Passing an external cooling fluid through the liquid/liquid heat exchanger cools the liquid desiccant and through that the air by contact with the media pads wetted with the cooled desiccant.

In accordance with one or more embodiments, in winter the air may be heated and humidified by contact with media pad or pads wetted with liquid desiccant that has been appropriately diluted. Passing an external warming fluid through the liquid/liquid heat exchanger warms the liquid desiccant and through that the air by contact with media pads wetted with the warmed desiccant. Thus, in all seasons the air humidity and temperature may be controlled independently by supplying the conditioner unit with a suitable heating or cooling fluid and a suitable desiccant concentration. Energy recovered from the exhaust air stream or other source will minimize the cooling and warming fluid required as well as the humidification fluid and dehumidification required. If energy recovery is not possible then heat recovery via a run-around coil system or other systems may be used.

In accordance with one or more embodiments, preheating and or precooling coil or coils may be added to or removed from either or both the conditioner unit and the energy recovery/regenerator unit at any time.

In accordance with one or more embodiments, there may be a pre-warming or precooling coil in the conditioner unit where condensate recovery is important or where energy recovery from the exhaust air is not possible and where only heat and cooling recovery is possible through a coil in the exhaust air. If there is no recovery possible from the exhaust air, the coil may remain to provide pre-conditioning to the conditioner unit.

In accordance with one or more embodiments, a separate heat/cool recovery coil system may be used where the exhaust air is contaminated or physically not available for desiccant energy recovery or regeneration. The heat/cool coil may be used for preheating the liquid desiccant or as a run around coil system with a coil before the media pads in the conditioner unit.

In accordance with one or more embodiments, post heating and or post cooling coil or coils may be added to or removed from either or both the conditioner unit and the energy recovery/regenerator unit at any time.

In accordance with one or more embodiments, a pre filter is an option on either or both the conditioner unit and the energy recovery/regenerator unit.

In accordance with one or more embodiments, a post filter is an option on either or both the conditioner unit and the energy recovery/regenerator unit.

In accordance with one or more embodiments, the appropriate increase in concentration of the liquid desiccant when required may be accomplished by the energy recovery/regenerator unit that is configured similarly to the conditioner unit, or optionally have a counter flow arrangement where the airflow is vertically upward and the desiccant flow is vertically downward, but used to evaporate water from the desiccant or recover energy from the exhaust air stream or other appropriate air supply. Thus, the conditioner unit and the energy recovery/regenerator unit may be essentially the same in construction but are used in different modes. Since the exhaust air is typically lower in volume than the supply air because of losses due to other exhaust fans where the air cannot be economically collected, the energy recovery/regenerator unit may be smaller and use less than the airflow of the conditioner unit. The exhaust air may be heated using the external warming fluid passed through a coil on the incoming air to the energy recovery/regenerator unit and/or through the liquid/liquid heat exchangers warming the liquid desiccant.

In accordance with one or more embodiments, there may be more than one conditioner unit going to each energy recovery/regenerator unit.

In accordance with one or more embodiments, there may be more than one energy recovery/regenerator unit for each conditioner unit.

In accordance with one or more embodiments, both the conditioner unit and the energy recovery/regenerator unit may be flexible and adaptable in construction. The media pads may be divided into sections such as the energy recovery section and the desiccant recirculation section of the conditioner unit and the energy recovery/regenerator unit and the desiccant recirculation section of the conditioner unit as well as the sections that are storage or flow to storage sections. The media pads may be custom engineered for the particular application and the number used in each unit may be varied to suit the climate and other operating requirements. The number and depth of media pads may be varied according to how much conditioning the supply air requires at design outside air conditions and other operating requirements. The media pad or pads may vary in height, width and spacing depending on design requirements. The depth of the media pads may also be split or divided so that not all of the media pads in any one system are the same.

In accordance with one or more embodiments, the system may be enclosed in a sealed but openable and accessible enclosure.

In accordance with one or more embodiments, the system may be housed in one enclosure or maybe separated or split into two or more enclosures. The enclosures will be sealed but will be openable and accessible for maintenance or other purposes.

In accordance with one or more embodiments, the storage tank or tanks may be enclosed in a sealed but openable and accessible space some distance from either or both the conditioner unit and the energy recovery/regenerator unit or may be housed in a common enclosure with either or both the conditioner unit and the energy recovery/regenerator unit or may be included within the energy recovery/regenerator unit.

In accordance with one or more embodiments, the airflow may be predominately horizontal through the conditioner unit and through the energy recovery/regenerator unit while the liquid desiccant may flow predominately vertically with gravity down the media pads thus the flow is cross flow.

In accordance with one or more embodiments the air flow may be S-shaped or snakelike, entering one end of one media pad and then entering through the opposite end of the next media pad, or the air flow may be C-shaped or U-shaped configuration, while passing predominately horizontally through the conditioner unit and or through the energy recovery/regenerator unit while the liquid desiccant may flow predominately vertically with gravity down the media pads thus the flow is cross flow.

In accordance with one or more embodiments, the airflow may be predominantly vertical rising through the energy recovery/regenerator while the liquid desiccant may flow predominantly vertically downward with gravity down the media pads thus the flow is a counter flow.

In accordance with one or more embodiments, multiple media pads in the conditioner unit and in the energy recovery/regenerator unit may be installed adjacent to one another, separated by more or less than 2 centimeters. This feature allows one or more media pad in a single unit. The more media pads, the closer the system becomes to 100% contact and 100% efficiency in energy transfer as well as filtering, purifying and sterilizing the air. The multiple pad efficiency means that the system may operate on low temperature heat sources. The temperature differential between the leaving air temperature from the conditioner unit and the warming or cooling fluid temperature may be less than 1° C. The temperature differential between entering air wet bulb on to the conditioner unit and the heating fluid temperature for the energy recovery/regenerator unit during high summer months may be less than 15° C. This allows the system to efficiently use clean, renewable energy sources such as raw ground heat exchange and inexpensive solar thermal panels thus helping to eliminate electric peak loads and electric refrigeration. Alternatively, the system may use the return water temperatures of chilled water systems where available or absorption refrigeration machines operating 3 times more efficiently at the higher cooling temperatures required by the disclosed system, and/or any low grade waste heat that is available.

In accordance with one or more embodiments, the multiple media pads in both the conditioner unit and in the energy recovery/regenerator unit are sequential, whether parallel to each other or in an S- or C- or U-shaped arrangement. As the air flows through from one wetted media pad to the next, the liquid desiccant does less and less energy transfer, thus the used desiccant from the first pad or pads of the intake side will be either more saturated than the desiccant from later pads as when the air passing through is more humid, or more concentrated as when the air passing through is drier than the pads further away from the air intake end.

In accordance with one or more embodiments, the ability of the conditioner unit to filter, purify and sterilize the air enables the use of less mechanical filtration and thus may reduce the system fan power.

In accordance with one or more embodiments, the ability of the conditioner unit to condition up to 100% outside air that is warm and moist using the same high temperature cooling fluid and thereby avoiding the use of any more electricity during these high outside conditions helping to reduce summer peak loads.

In accordance with one or more embodiments, due to the ability to have a low frictional resistance through both the conditioner unit and through the energy recovery/regenerator unit for minimum fan power requirements, the only electricity required in most cases is for small pumps for pumping around the liquid desiccant and warming and cooling fluids and small fans to move the air in the conditioner supply air unit and the regenerator/energy recovery unit in the exhaust air system or the regenerator unit and exhaust recovery units.

In accordance with one or more embodiments, the system may employ low grade heat and cooling from renewable sources such that the system may require less than 1 KW of electricity during the high summer months to better accomplish over 100 KW of cooling and dehumidification of outside air.

In accordance with one or more embodiments, the liquid desiccant distribution system and spray system to the wetted media pads at the top of the pads and the collection of the liquid desiccant at the bottom of the pads is isolated from the air streams in the conditioner unit and may also be isolated in the energy recovery/regenerator unit where the airflow is predominantly horizontal. Sealing and isolating the liquid desiccant supply sprays and collection streams from the air stream together with low air velocities through the units helps eliminate the risk of micro droplets of the desiccant entering the air stream.

In accordance with one or more embodiments, the liquid desiccant in the conditioner unit may flow into one of an optional three sumps. The desiccant from the media pads that have done the most energy transfer may flow into a sump that is then piped to the energy recovery/regenerator unit to be used as an energy recovery system whether the regenerator is being used or not. The desiccant from the next media pad or pads has done less energy transfer and may be piped directly into the storage tank or tanks or into the sump on the energy recovery/regenerator unit. The desiccant from the media pads closest to the conditioned supply airside of the conditioner unit has done the least amount of energy transfer and may be piped directly back into the piping system that flows back into the conditioner unit.

In accordance with one or more embodiments, the desiccant from the horizontal type energy recovery/regenerator unit may flow into one of an optional two sumps. The desiccant from the media pads closest to the air entry side of the unit will have the most energy transfer/recovery and may be stored in the energy recovery/regenerator unit sump or may be piped directly into the storage tank or tanks. The desiccant from the media pads further from the air entry side of the unit may be recycled back into the energy recovery/regenerator unit for further energy transfer/recovery before flowing into the storage system.

In accordance with one or more embodiments, the desiccant from the storage tank or tanks may flow into the energy recovery/regenerator unit for further concentration or energy transfer/recovery.

In accordance with one or more embodiments, the desiccant storage tank(s) or energy recovery/regenerator sump may take several forms that are allowable so long as the dilute and the concentrated desiccant are allowed to remain separated which they have a tendency to do when separated vertically by gravity. This may be achieved either by using two storage tanks and arranging appropriate flow between them or a single storage container may be used with the more dilute desiccant lying on top of the heavier, concentrated desiccant.

In accordance with one or more embodiments, the storage tank or tanks may be oversized or one of a number of tanks may be used as a standby tank during peak seasonal loads.

In accordance with one or more embodiments, the distribution pipework to the multiple media pads in both the conditioner unit and the energy recovery/regenerator unit is an equal pressure/equal flow design such that it enhances equal liquid desiccant flow to the media pads even when the volume is varied and when there are more or fewer media pads. The equal distribution of the desiccant to the media pads, even under variable flows, enhances the performance of all the media pads and the performance during differing outside air conditions and winter and summer conditions. This achieves the equal flow to the media pads throughout a range of flows from a pumping system during both summer and winter conditions. This pipework system will continue to provide equal flows to the media pads when one or more of the multiple media pads may be isolated. The distribution system allows the introduction of different width media pads that can be served equally by the distribution pipework.

In accordance with one or more embodiments, isolating, varying and integrating the volume flow of desiccant, the height of the media pad or pads, the width of the media pad or pads and the depth of the media pad or pads and the air speed through the system optimizes its operation throughout the yearly variances in outside weather. This is allowed by the equal pressure design of the supply distribution piping system together with the media pads and fan systems that may have variable capacities. Both the air volume and the desiccant volume may be varied through the media pads. The air speed may vary between 0.5 M/s (Meters per second) to 3.5 M/s and the desiccant may vary from 0.3 L/s Liters per second) per square Meter to 2.7 L/s per square Meter media pad cross section. The height per media pad may vary from up to 3 Meters high as the highest single or multiple pads served by a single spray header each and the shortest single or multiple pads down to 0.15 Meter high. This allows the development of very small to very large size units with single or multiple height media pads, from 5 L/s to 50,000 L/s. Media pads may be removed individually for cleaning, rotating the pads or replacement at some time. Optimizing the fan power by varying the air volume is another feature that minimizes the system's electrical use.

In accordance with one or more embodiments, where the exhaust air or other source is not available for energy or heat recovery, the system may be comprised of a conditioner unit, regenerator unit and storage system.

Many construction variations can be embodied combining various elements mentioned. The present invention is in no way limited to a specific combination of said elements. These and other features, aspects and advantages of the present invention will become better understood with reference to the following description and claims.

DETAILED DESCRIPTION OF ILLUSTRATIVE EMBODIMENTS

The advantages and features of the system may be better understood by reference to the following detailed description of illustrative embodiments and accompanying figures. It is to be understood that this invention is not limited to the specifics detailed therein as they describe a particular embodiment as an example only.

Figure 1:
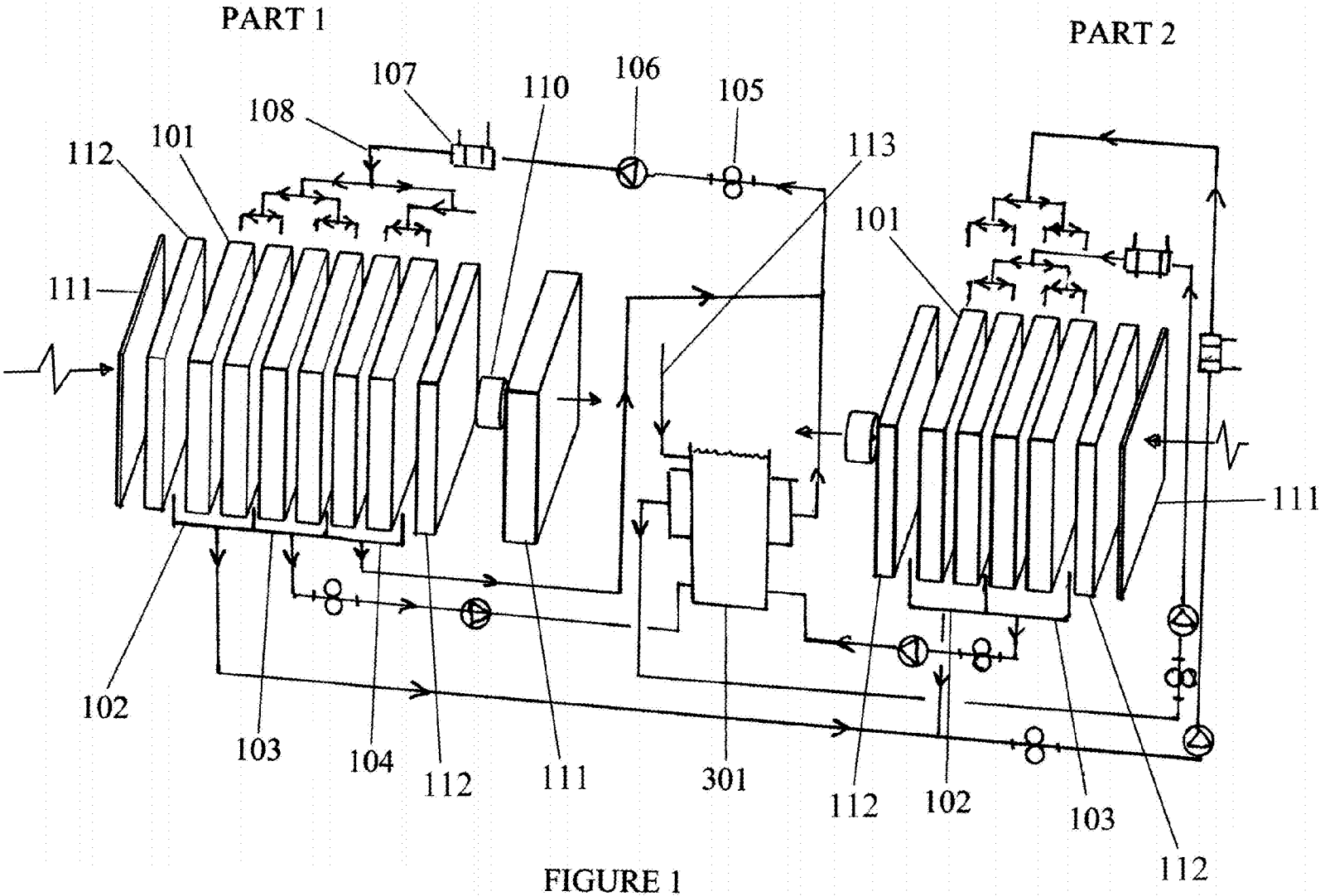
FIG. 1 is an exemplary and non-limiting schematic of the liquid desiccant air conditioning system in accordance with one or more embodiments.

FIG. 1 is an exemplary illustration for an embodiment of the liquid desiccant air conditioning system invention. In this illustrative embodiment, the airstream enters at the supply side of the conditioner unit PART 1, and may pass through an optional filter 111 and then through an optional heating/cooling coil 112, which is connected to an external source to preheat or precool the air or to an energy recovery source from the energy recovery/regenerator unit PART 2. The air then passes sequentially over absorbent media pad or pads 101 that have been wetted with a specific concentration and temperature of a liquid desiccant for the desired (specified) amount of humidity and temperature required in the supply or process air. The supply or process air is cooled and dehumidified where necessary by cooling a concentrated liquid desiccant and heated and humidified where necessary by heating a diluted liquid desiccant. A heat exchanger 107 in the liquid desiccant piping will heat or cool the liquid desiccant using an external heat source or energy recovery source. The air is also being filtered, purified, and sterilized through contact with the liquid desiccant wetted media pads 101. The air then passes through an optional conditioning coil 112 through the fan 110 and then through an optional filter 111 and then exits at the opposite side to the entry side, the air being drawn through or pushed through the device by a fan 110 to a space or process served. The liquid desiccant piping 108 has optional strainers 105 to remove particulates from the desiccant and pumps 106 moving the desiccant through the supply pipework 108 to the sparge pipework 109 which supplies liquid desiccant to the media pads. The liquid desiccant flows down the media pads 101 and into either an optional energy recovery sump 102, a sump 103, or an optional desiccant recirculating sump 104. The liquid desiccant flowing into the energy recovery sump 102 flows through pipes to the media pads 101 in the energy recovery/regenerator unit PART 2 through which exhaust air or some other air source passes. There is an optional heat exchanger 107 in the liquid desiccant piping that will heat or cool the liquid desiccant using an external heat source or energy recovery source. The air in the energy recovery/regenerator unit PART 2 may first pass through a filter 111. The air may pass through an optional heating or cooling coil 112. An external heat source may be used or the exhaust air from the conditioned space/process or some other convenient useful source of airflow may be used as an energy recovery source. The energy recovery/regenerator will add moisture to the concentrated liquid desiccant or remove moisture from the diluted liquid desiccant. The air may then pass through an optional coil 112 to recover energy prior to exhausting. The air then exits to the opposite side from where it entered, drawn through or pushed through the device by a fan 110 to be exhausted to the outside. The now regenerated or energy recovered liquid desiccant goes into one or more storage tanks 301 where it is held in reserve or it may be stored in a sump 103 on the energy recovery/regenerator unit or it may be recirculated from the energy recovery/regenerator sump 102 back into the energy recovery/regenerator unit PART 2 for further energy recovery or regeneration. The liquid desiccant from the sump 103 is then piped into the storage tank 301 or forms a storage system of its own. The liquid desiccant from the recirculating sump 104 in the conditioner unit PART 1 is piped back to mix with the liquid desiccant from the storage system and flows back into the conditioner unit PART 1. In winter, or when more humidity is needed for the space or process, water is piped 113 into the liquid desiccant being held in the storage system. In summer, or when water is condensed or evaporated from the diluted liquid desiccant, it will be exhausted outside or optionally recovered and stored. The liquid desiccant in the storage system passes through an optional heat exchanger 107 that is attached to an external heating or cooling source to preheat or precool the liquid desiccant and then through the energy recovery/regenerator unit PART 2 before returning to the storage system 301 or sump 103 in the energy recovery/regenerator. The pipework shall have valves of appropriate size and type for isolation of parts and systems and control of fluids wherever necessary. There are controls for temperature, humidity, level and flow where appropriate.

Cold, dry air, when entering the conditioner unit PART 1, is warmed and absorbs moisture to a specified temperature and humidity level before it enters the space/process being served. Warm, moist air, when entering the conditioner unit PART 1, is cooled and dehumidified to a specified temperature and humidity level before entering the space/process being served. The air may be 100% outside air or may be mixed with recirculated air or may be 100% recirculated air. The ability of the conditioner unit PART 1 to filter, purify, and sterilize the air to a certain degree, enables the use of less mechanical filtration and thereby reduces the system pressure losses and fan power necessary to move the air, minimizing electrical use year round. The ability of the media pads 101 to condition the air and require less coils or eliminate coils reduces the system pressure losses and fan power necessary to move the air, minimizing electric power use year round.

The liquid desiccant is concentrated when it is required to dehumidify and diluted when required to humidify. In this illustrative embodiment, the liquid desiccant concentration level is controlled by a mechanism in the storage tank(s) 301 or energy recovery/regenerator unit sump 103 sensing the desiccant level to achieve the desired level and therefore concentration for the system mode of either dehumidification where the level may be lower, or humidification where the level may be higher. Other forms of the liquid desiccant concentration control are optional.

Low grade heat and cooling and very low amounts of electricity may be used even during the high summer months to provide cool, dry air to a space/process or during the high winter months to provide warm moist air. The only electricity required in most cases is for small pumps 106 for pumping around the liquid desiccant and warming and cooling fluids and fans 110 to move the air in the conditioner unit PART 1 and the regenerator/energy recovery unit PART 2 in the exhaust air system or the regenerator unit and exhaust units. The disclosed system has low frictional resistance through the units for minimum fan power requirements and is able operate on low temperature warming fluid for warming and dehumidification and high temperature cooling fluid for cooling and preheating together with energy or heat recovery systems and has the ability to filter, purify and sterilize the air passing through. The low grade heat and cooling sources may be such that clean, renewable sources may provide most of the heating and cooling, such as ground heat exchange for the cooling and prewarming and solar thermal for dehumidification and warming.

Systems airflow sizes may be from 5 L/s to 50,000 L/s (liters per second) with single height media pad sections, giving the system the ability to be easily produced in both large sizes for commercial, institutional and industrial use and in small sizes for residential and single room applications. Multiple media pad sections may increase the size of the system through stacking or adjacent sections. The system may be a stand-alone air unit or be the treatment section for the outside air for a larger HVAC (Heating, Ventilating and Air Conditioning) unit.

Figure 2B:
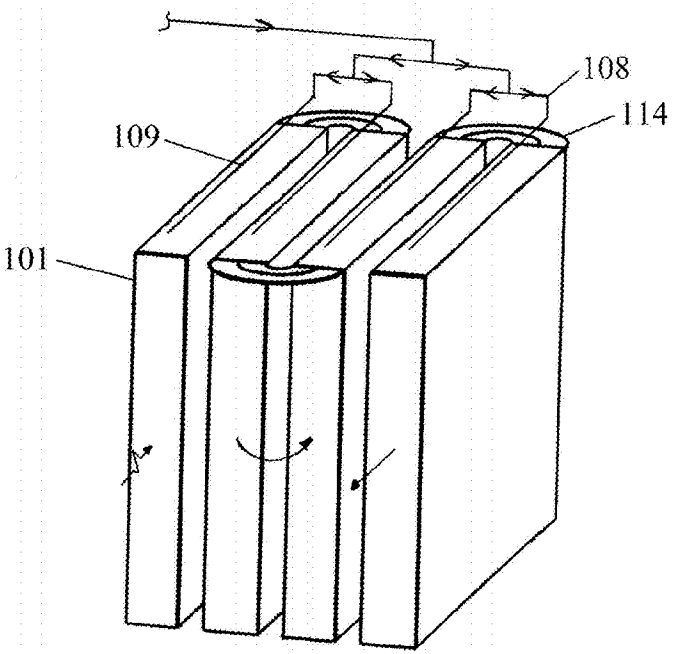
FIG. 2B is an exemplary and non-limiting schematic of the distribution piping layout and media pads layout of S-shaped airflow through the conditioner unit in accordance with one or more embodiments.
Figure 2A:
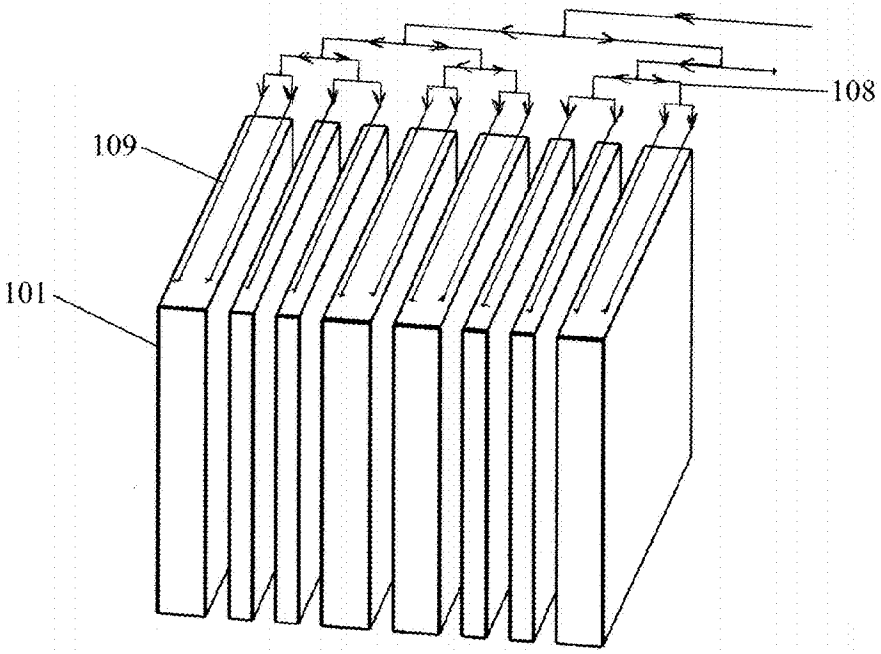
FIG. 2A is an exemplary and non-limiting schematic of the distribution piping layout and media pads layout of straight through airflow through a conditioner or energy recovery/regenerator unit in accordance with one or more embodiments.

FIGS. 2A and 2B depicts an illustrative embodiment of the equal pressure/equal flow piping distribution 108 to the media pads 101 and the sparge piping desiccant delivery piping system 109. The piping 108 is designed such that there is always an equal flow of liquid desiccant to all the media pads 101 via the sparge pipes 109. The number and orientation of the media pads 101 may vary depending upon the requirements of the space/process to be served and the size of the system. Media pads 101 may be split when in a straight through system as embodied in FIG. 2A. The piping system 108 design is such that media pads may be added or removed at any time which may be for cleaning or seasonal changeover, and the sparge piping 109 to that pad or pads turned on or turned off and all the remaining media pads will receive equal flows of desiccant. The pumps 106 may be varied in volume or remain constant in volume.

In FIGS. 2A and 2B the distribution pipework 108 to the multiple media pads 101 is an equal pressure/equal flow design such that it enhances equal liquid desiccant flow to the media pads even when the volume is varied and when there are more or fewer media pad sections. The equal distribution of the desiccant to the media pads, even under variable flows, enhances the performance of all the media pads and the performance during differing outside air conditions and winter and summer conditions. This achieves the equal flow to the media pads throughout a range of flows from a pumping system during both summer and winter conditions. This pipework system will continue to provide equal flows to the media pads when one or more of the multiple media sections may be isolated or added. The distribution system allows the introduction of different width media pads that can be served equally by the distribution pipework.

In FIGS. 2A and 2B the gravity flow of the liquid desiccant from the top of the pads to the bottom allows for minimal clogging while the liquid desiccant acts as an air filter. The desiccant does not enter the airstream but comes in contact with the wetted media pad or pads 101 and the air to exchange energy. The liquid desiccant piping distribution system 108 and spray sparge piping system 109 to the top of the media pads 101 and the collection of the liquid desiccant at the bottom of the media pads is isolated from the air stream in the conditioner unit and horizontal type energy recovery/regenerator unit. Sealing and isolating the liquid desiccant supply sprays and collection streams from the air stream together with sufficiently low air velocities through the units eliminates the risk of micro droplets of the desiccant entering the air stream.

FIG. 2A depicts an illustrative embodiment of the air flowing in one direction from one media pad to the next adjacent pad. The space between multiple media pads 101, may be greater or less than 0.02 Meter. Isolating, varying and integrating the volume flow of liquid desiccant, the height and width of the media pads and the depth of the media section and the air speed through the system may optimize the system operation for a particular space/process or throughout the yearly variances in outside weather. This is allowed by the equal pressure design of the supply distribution piping system together with the multiple media pads and fan systems that may have variable capacities. Both the air volume and the desiccant volume may be varied through the media pads by up to 600%. The air speed may vary between 0.5 M/s to 3.5 M/s (meters per second) and the desiccant may vary from 0.3 L/s (liters per second) to 3.5 L/s per square meter of media cross section. The height per media section may vary from 0.15 Meter to 3 M high as the shortest and highest single section(s) served by a single piped header each. This allows the development of very small to very large size units with single height media pads, from 5 L/s (liters per second) to 50,000 L/s. Media pads may be removed individually for cleaning, rotating or replacing the pads at some time.

FIG. 2B depicts an illustrative embodiment of the airflow in an S-shaped configuration. It may be in a C-shaped or it may be a U-shaped configuration or it may be any configuration or airflow to accomplish the required media depth for either the conditioner unit PART 1 and/or the energy recovery/regenerator unit PART 2. These configurations may be for a small volume of airflow requirement. These configurations may be to allow a compact arrangement for an air conditioning system, either as a single complete system or in separate parts as a split system. The media pads may be as narrow as less than 0.02 Meter wide and may be as short as 0.15 Meter high. The sparge piping 109 arrangement may be along or against the airflow instead of across the airflow as in other systems.

Figure 3B:
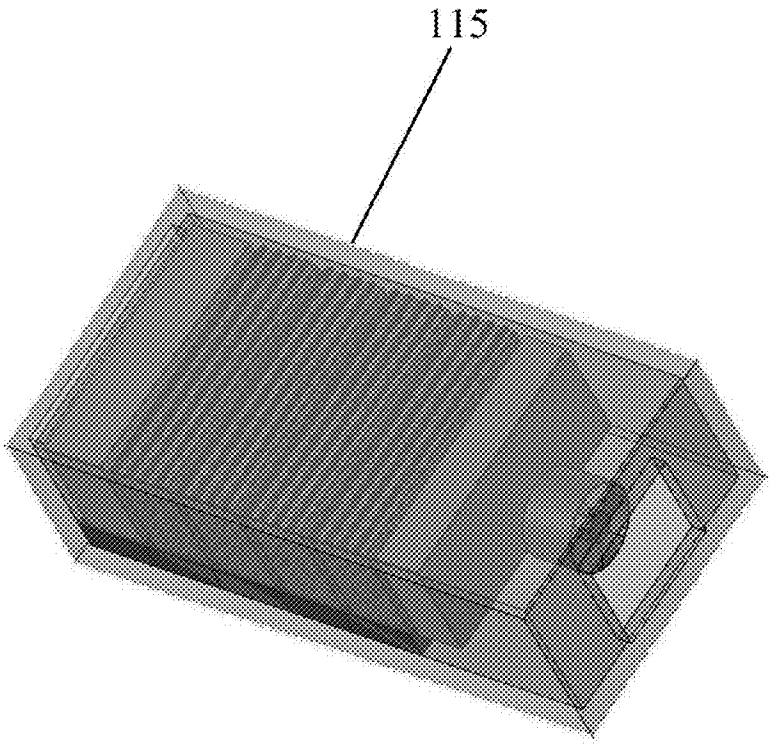
FIG. 3B is an exemplary and non-limiting isometric view of a horizontal type energy recovery/regenerator unit in an enclosure in accordance with one or more embodiments.
Figure 3A:
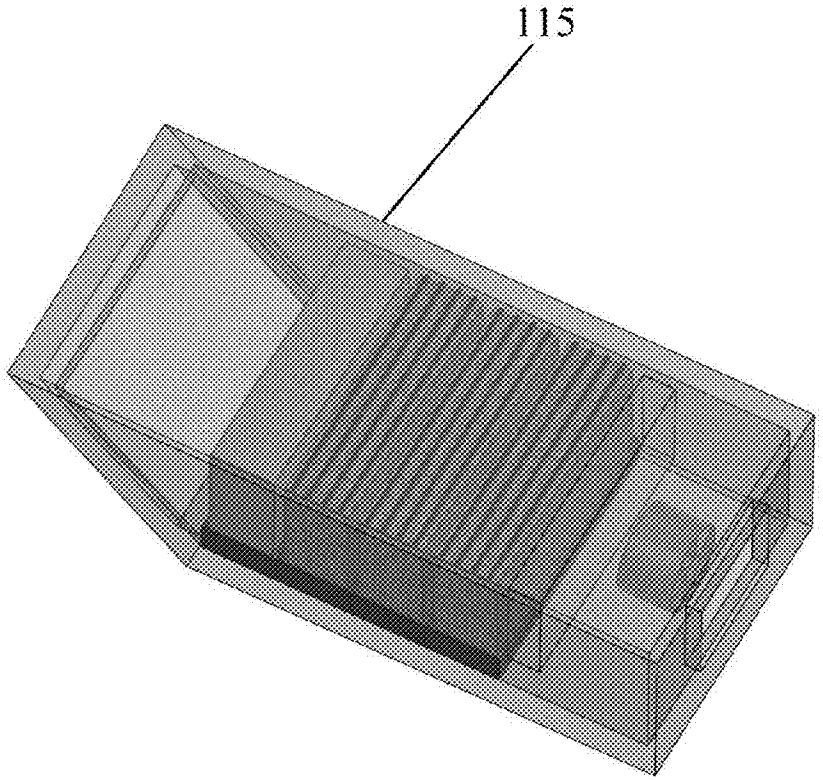
FIG. 3A is an exemplary and non-limiting isometric view of a conditioner unit in an enclosure in accordance with one or more embodiments.

FIG. 3A depicts an illustrative embodiment of the conditioner unit PART 1, showing the unit within an example of an enclosure 115.

FIG. 3B depicts an illustrative embodiment of the horizontal energy recovery/regenerator unit PART 2, showing the horizontal unit within an example of an enclosure 115.

Having thus described several illustrative embodiments, it is to be appreciated by those skilled in the art that other embodiments may be made. Such embodiments are intended to be within the spirit and scope of the claims of this disclosure. While some embodiments presented in this dis-closure, it should be understood that these are illustrative only. The functions and elements described may be combined in many variations to accomplish the objectives, similar and different. Changes may be made in details including, but not limited to shapes, sizes, numbers of elements and arrangement of parts along with changes in flow of either or both air and liquid desiccant without exceeding the scope of the invention. Additionally, elements and components may be further divided into additional or less components for performing the same or similar functions. The description herein and attached drawings are by way of example only and are not intended to be limiting.

What is claimed:

1. A system for conditioning air comprising:

a liquid desiccant air conditioning system that is flexible, adaptable and scalable; and a conditioner unit within a generally sealed but accessible and openable enclosure to draw in air and condition it to the required temperature level and the required humidity level, and the ability to filter it by passing it through a series of one or more media pads wetted with a liquid desiccant before supplying it to a space or process to be conditioned while having any appropriate air resistance including and preferably a very low air resistance through the unit with the air moving in a predominately horizontal direction and the desiccant moving in a predominately vertical direction flowing into one or more of the following collection sumps: an energy recovery sump or a desiccant recirculating sump or a sump that returns the desiccant to the desiccant storage system; and an energy recovery/regenerator unit within a generally sealed but accessible and openable enclosure to regenerate the liquid desiccant to be reused and or recover energy from exhaust air or other air source by passing it through one or more media pads where the air and liquid desiccant will either be configured in a cross flow arrangement similar to the conditioner unit with the desiccant flowing into a collection/storage sump and or an energy recovery sump where the desiccant is returned to the energy recovery/regenerator unit, or configured in a counter flow arrangement where the air flows predominantly vertically up through the media pads and the desiccant flows predominantly vertically down through the media pads into a collection/storage sump; and has desiccant storage within the energy recovery/regenerator unit and or one or more storage tanks to hold liquid desiccant to be sent the conditioner unit and or the energy recovery/regenerator unit; and arranged where the conditioner unit, the energy recovery/regenerator unit and or the storage tank(s) are within a single enclosure or arranged in a split system; and an equal pressure/equal flow distribution piping system that is used for the desiccant supply to the conditioner unit and to the energy recovery/regenerator unit; and a liquid desiccant; and the ability to use a low temperature differential between the cooling/warming source and the leaving conditioning air and between the dehumidifying heat source and the regenerator air temperature; and the ability to use low grade and or clean renewable energy sources for heating and cooling the desiccant and air as well as regenerating the desiccant;

a. the system for conditioning the air as set forth above uses one of the following: 100% outside air; or a mixture of outside air and recirculated air in any ratio; or 100% recirculated air;

b. the system for conditioning the air as set forth above accommodates different air flow speeds and volumes; and where larger volumes are required there are different configurations such as units double and triple stacked and/or adjacent or with other types of media pads;

c. the system for conditioning the air as set for above wherein the predominantly horizontal air flow moves in one of the following configurations: a predominantly straight direction passing from one media pad to the next; a predominantly S-shaped pattern entering one media pad from one end and the next sequential media pad from the opposite end; a predominantly U- or C-shaped pattern or other combination of patterns to provide the required depth of media;

d. the system for conditioning the air as set forth above accommodates different liquid desiccant flow rates per square meter of media pad cross section including a low flow and high flow of liquid desiccant;

e. the system for conditioning the air as set for above wherein said conditioner unit and said energy recovery/regenerator unit have one or more of the following additions: a pre conditioning air coil used for heating/cooling and or energy recovery; a post conditioning air coil used for heat/cooling and or energy recovery; a prefilter; a post filter;

f. the system for conditioning the air as set for above wherein the thermal efficiency is such that the supply air temperature from said conditioning unit is preferably within 1° C. of the external cooling or warming temperature source;

g. the system for conditioning the air as set forth above wherein the filtering, purifying and sterilizing efficiency preferably approaches 100% with sufficient desiccant contact by depth of media pads and desiccant flow rates;

h. the system for conditioning the air as set forth above utilizes one or more heat exchangers sized such that there is preferably less than a 0.5° C. difference in temperature between the cooling and warming source temperature and the leaving desiccant temperature;

i. the system for conditioning the air as set forth above wherein the system is configured such that there are one or more conditioner units served from one energy recovery/regenerator unit or a system configured such that there are one or more energy recovery/regenerator units served from one conditioner unit;

j. The system for conditioning the air as set forth above wherein the moisture removal efficiency is such that the regenerator unit uses an external warming fluid preferably within 15° C. of the regenerator supply air wet bulb temperature;

k. the system for conditioning the air as set for above wherein water is added to the liquid desiccant when humidity is required to be added to the conditioned air.

2. The system for conditioning the air as set forth in claim 1 wherein:

in the conditioner unit and the energy recovery/regenerator unit where the airflow is predominantly horizontal, there are one or more media pads in a predominately vertical aspect onto which the liquid desiccant flows predominately vertically down with gravity from the top of the pads to the bottom of the pads, wetting the pads and then into one of the optional three types of sumps while the air stream, utilizing a fan to push or pull air through the unit, passing through wetted media pads one after another, in this way, the liquid supply to and collection from the media pads is isolated from the air stream while the air is filtered and while adding or subtracting moisture and heat and then is used as supply air; and said media pads are configured in one or more depths so that some are deeper than others; and said media pads are one or more than one in number; and said media pads are spaced at 2 centimeters apart or closer together or farther apart; and said media pads can vary in height and width to allow for larger air volumes or different configurations; and said media pads in the energy recovery/regenerator unit are arranged in either a predominately horizontal arrangement with the desiccant flowing predominately vertically down in a counter flow arrangement or the media pads are arranged in a predominantly vertical arrangement with the desiccant flowing predominantly vertically in a cross flow arrangement;

a. The system for conditioning the air as set for above wherein the flexibility, adaptability and scalability of the system allows the height of the media pads such as Munters, CELdek and GLASdek type to vary from 0.15 Meter to 3 Meters and the width of the media pads to vary from 0.02 Meter to 10 Meters and the depth of the media pads to vary from 0.2 Meter to 3 Meters in a single conditioner or energy recovery/regenerator unit; other types of media pads vary to a greater or lesser extent in one or more of the following: the height, width and depth.

3. The system for conditioning the air as set forth in claim 1 wherein there is an equal pressure and equal desiccant flow distribution supply piping to said conditioner unit and said energy recovery/regenerator unit; and allows for equal distribution of the liquid desiccant across all media pads and allows for isolation and optional removal or addition of any of the media pads while the flow from the piping remains equal to all remaining pads; varying the flow of the desiccant does not affect the equal distribution of the liquid desiccant to all the media pads.

4. The system for conditioning the air as set for in claim 1 wherein the liquid desiccant in the conditioner unit flows into one of the optional sumps; the desiccant that flows from the first or first several entry air side media pads on the conditioner unit has done the most energy transfer so it flows into the optional energy recovery sump where it is piped such that it is pumped through an optional heat exchanger to preheat or precool the fluid after it passes through a strainer and then into said energy recovery/regenerator unit where it will lose or add moisture and heat to the liquid desiccant depending upon the requirements; and wherein the liquid desiccant in the conditioner unit that flows from the last or last several exit air side media pads on the conditioner unit has done the least energy transfer so it flows into an optional desiccant recovery sump where it is piped such that it is pumped through said heat exchanger to preheat or precool the fluid after it passes through a strainer after being mixed with the desiccant from the storage system and returned into said conditioner unit; and wherein the liquid desiccant in the conditioner unit that flows from the middle pad or several middle pads on the conditioner unit has done the average energy transfer so it flows into an optional desiccant sump where it is piped such that it is pumped through a strainer and then returned into said storage unit; and wherein the liquid desiccant from the storage system is pumped through said heat exchanger to preheat or precool the fluid after it passes through a strainer into said conditioner unit; and wherein the liquid desiccant in the energy recovery/regenerator unit flows into one of the optional sumps; the desiccant that flows from the last or last several exit air side media pads on the energy recovery/regenerator unit has done the least energy transfer so it flows into an optional energy recovery sump where it is piped such that it is mixed with the desiccant from the energy recovery sump in the conditioner unit and pumped through an optional heat exchanger to preheat or precool the fluid after it passes through a strainer and returned into said energy recovery/regenerator unit; and wherein the liquid desiccant in the energy recovery/regenerator unit flows into one of the optional sumps; the desiccant that flows from the first or first several entry air side media pads on the energy recovery/regenerator unit has done the most energy transfer so it flows into an optional desiccant sump where it is piped such that it is pumped through a strainer and then returns into said storage unit; or is stored in the sump as part of the unit itself; and wherein the liquid desiccant from the storage system is pumped through said heat exchanger to preheat or precool the fluid after it passes through a strainer into the said energy recovery/regenerator unit.

* * * * *